US011066894B2

(12) United States Patent
Stone

(10) Patent No.: US 11,066,894 B2
(45) Date of Patent: Jul. 20, 2021

(54) SPRING LOADED INNER DIAMETER OPENING BALL SEAT

(71) Applicant: Matthew Stone, Humble, TX (US)

(72) Inventor: Matthew Stone, Humble, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 119 days.

(21) Appl. No.: 16/431,348

(22) Filed: Jun. 4, 2019

(65) Prior Publication Data

US 2020/0386069 A1 Dec. 10, 2020

(51) Int. Cl.

| | |
|---|---|
| ***E21B 34/14*** | (2006.01) |
| ***E21B 33/12*** | (2006.01) |
| ***E21B 34/10*** | (2006.01) |
| ***E21B 34/06*** | (2006.01) |
| ***E21B 43/26*** | (2006.01) |

(52) U.S. Cl.

CPC ..... *E21B 33/12* (2013.01); *E21B 34/063* (2013.01); *E21B 34/10* (2013.01); *E21B 43/26* (2013.01); *E21B 2200/06* (2020.05)

(58) Field of Classification Search

CPC ..... E21B 34/14; E21B 2200/06

See application file for complete search history.

(56) References Cited

U.S. PATENT DOCUMENTS

| | | | | |
|---|---|---|---|---|
| 4,520,870 | A * | 6/1985 | Pringle | E21B 34/14 166/317 |
| 8,991,505 | B2 * | 3/2015 | Fleckenstein | E21B 43/14 166/373 |
| 9,004,180 | B2 * | 4/2015 | Jackson | E21B 23/006 166/373 |
| 9,366,110 | B2 * | 6/2016 | Feng | E21B 34/14 |
| 9,574,414 | B2 * | 2/2017 | Arabsky | E21B 23/06 |
| 10,450,814 | B2 * | 10/2019 | Jones | E21B 21/103 |
| 10,837,269 | B2 * | 11/2020 | Feng | E21B 34/14 |
| 2006/0272824 | A1 * | 12/2006 | Adams | E21B 34/14 166/373 |
| 2010/0282338 | A1 * | 11/2010 | Gerrard | E21B 34/14 137/330 |
| 2012/0305236 | A1 * | 12/2012 | Gouthaman | E21B 41/00 166/118 |
| 2013/0192846 | A1 * | 8/2013 | Garcia | C22C 19/05 166/373 |
| 2014/0014340 | A1 * | 1/2014 | King | E21B 43/26 166/285 |
| 2015/0107829 | A1 * | 4/2015 | Themig | E21B 43/14 166/255.1 |
| 2015/0176361 | A1 * | 6/2015 | Prosser | E21B 34/14 166/192 |

(Continued)

*Primary Examiner* — Kipp C Wallace

(74) *Attorney, Agent, or Firm* — Cantor Colburn LLP

(57) ABSTRACT

A frac sleeve assembly for use in a downhole operation and method of use are disclosed. The frac sleeve assembly includes a sleeve movable within a housing and a ball seat movable within the sleeve. The sleeve includes a pin adjusting element. The ball seat includes a seat tooth disposed at a fluid passage of the ball seat for seating a ball, and a pin associated with the seat tooth. Motion of the ball seat within the sleeve causes the pin adjusting element to move the pin to adjust the seat tooth to release the ball.

15 Claims, 6 Drawing Sheets

(56) References Cited

U.S. PATENT DOCUMENTS

| | | | | |
|---|---|---|---|---|
| 2015/0247380 | A1* | 9/2015 | Avery | E21B 34/12<br>166/373 |
| 2015/0267506 | A1* | 9/2015 | Avery | E21B 33/124<br>166/373 |
| 2018/0010406 | A1* | 1/2018 | Jones | E21B 21/103 |

* cited by examiner

SPRING LOADED INNER DIAMETER OPENING BALL SEAT

BACKGROUND

In the resource recovery industry, formation fracturing ("fracking") is used to increase a hydrocarbon output from a reservoir by introducing fracking fluid from a production string into the reservoir. The production string includes a port and a frac sleeve that opens and closes the port to control flow of frac fluid into the reservoir. The frac sleeve includes a tubular passage with a ball seat therein. A ball is dropped through the production string to land on the ball seat, thereby blocking a fluid passage through the frac sleeve. Fluid pressure can be then applied to the ball and ball seat in order to move the frac sleeve axially from a closed position, thereby opening the port. When desired, a disintegrating fluid is pumped downhole to dissolve the ball, thereby releasing the fluid pressure on the frac sleeve, allowing the frac sleeve to move back to its closed position, thereby closing the port. A problem that occurs during ball dissolution is that the ball can become cemented into the ball seat, thereby preventing closure of the port as desired. Accordingly, there is a need for a ball seat that allows for the ball to pass through the ball seat without cementation.

SUMMARY

In one aspect, a frac sleeve assembly for use in a downhole operation is disclosed. The frac sleeve assembly includes a sleeve movable within a housing, the sleeve including a pin adjusting element, and a ball seat movable within the sleeve. The ball seat includes a seat tooth disposed at a fluid passage of the ball seat for seating a ball, and a pin associated with the seat tooth, wherein motion of the ball seat within the sleeve causes the pin adjusting element to move the pin to adjust the seat tooth to release the ball.

In another aspect, a method of operating a frac system is disclosed. The method includes receiving a ball at a seat tooth disposed at a fluid passage of a ball seat, the seat tooth having an associated pin; and moving the ball seat within a sleeve to a location at which a pin adjusting element of the sleeve moves the pin to adjust the seat tooth to release the ball.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
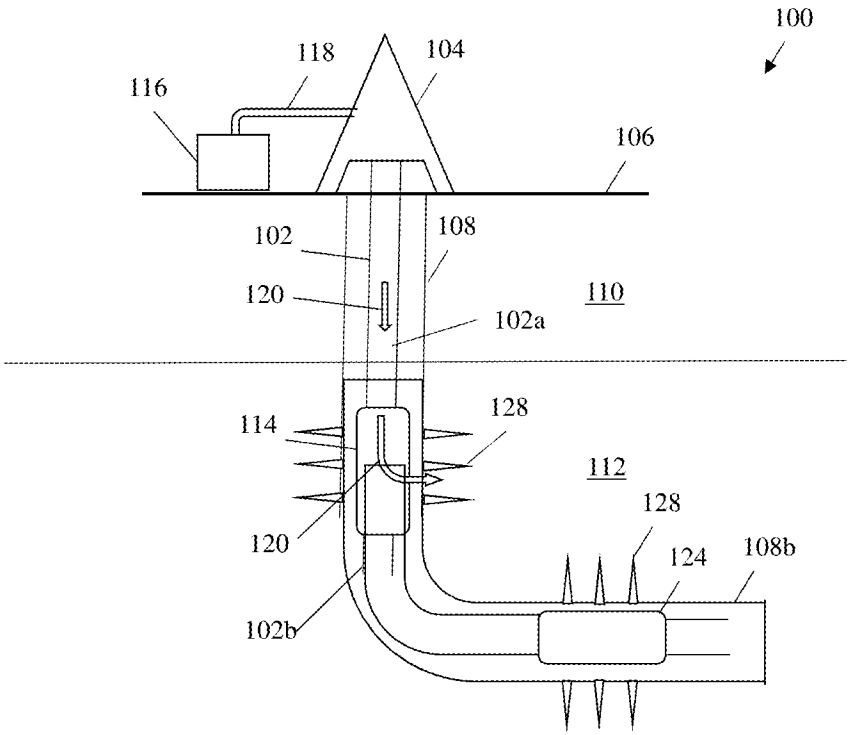
FIG. 1 shows an illustrative production system.

Referring to FIG. 1, an illustrative production system 100 is shown. The production system 100 includes a production string 102 extending from a rig 104 located at a surface location 106. The production string 102 extends through a wellbore 108 penetrating a formation 110 and a reservoir 112 in the formation 110. A fracture ("frac") assembly 114 is disposed on the production string 102 at a location in the reservoir 112 for the purposes of fracking the reservoir 112. The frac assembly 114 is disposed between a first section 102*a* of the production string 102 and a second section 102*b* of the production string 102. A second frac assembly 124 can be disposed at a lower end of the second section 102*b*. Additional frac assemblies (not shown) can also be disposed at lower sections of the production string 102. As shown in FIG. 1, the wellbore 108 can deviate to have a horizontal section 108*b* and the production string 102 can deviate along with the wellbore 108 to extend through the horizontal section 108*b*. One or more of the frac assemblies (such as second frac assembly 124) can be disposed within the horizontal section. Also, one or more frac assemblies can be disposed within the vertical section.

In order to perform a frac operation, a frac fluid 120 is pumped from a frac fluid storage device 116 through delivery pipe 118 and down through the production string 102 to exit the frac assembly 114 into the reservoir 112. In various embodiments, various perforations 128 can be previously formed in the reservoir 112 through which the frac fluid 120 passes into the reservoir 112. Proppant entrained in the frac fluid 120 is carried into the perforations 128 in order to prop the perforations 128 open, thereby allowing for increased hydrocarbon recovery from the reservoir 112. As discussed below with respect to FIG. 2, the frac assembly 114 includes elements that can be moved therein in order to control the frac operation by opening a port to release the frac fluid 120 into the reservoir 112 and by closing the port to stop the flow of frac fluid 120 into the reservoir 112.

Figure 2:
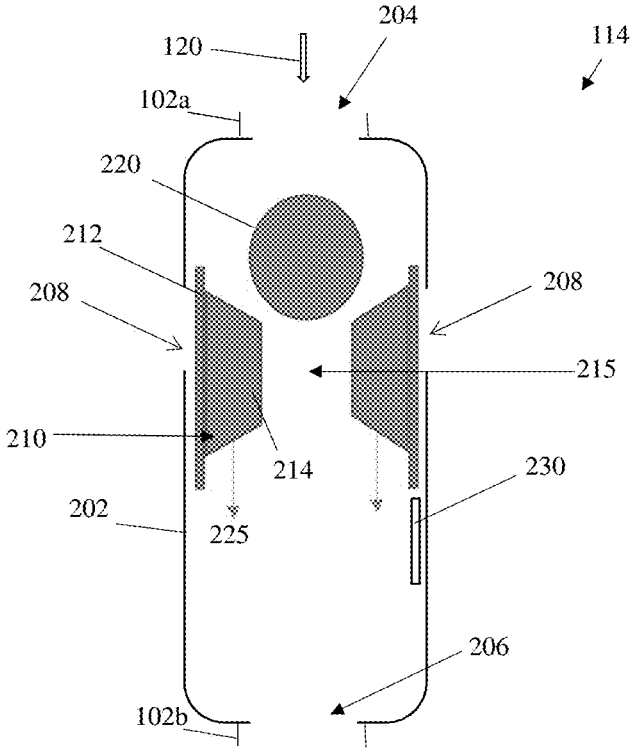
FIG. 2 shows a detailed diagram of an illustrative frac assembly of the production system in various embodiments.

FIG. 2 shows a detailed diagram of an illustrative frac assembly 114 of the production system 100 in various embodiments. The frac assembly 114 includes a housing 202 coupled to the production string 102. The housing 202 includes an inlet 204 at an intersection of the housing 202 and the first section 102*a* of the production string 102. The housing 202 also includes an outlet 206 at an intersection of the housing 202 and the second section 102*b* of the production string 102. The housing 202 further includes port 208 in the wall of the housing 202 for delivery of frac fluid 120 from the frac assembly 114 into the reservoir 112. The port 208 can be opened or closed based on a position of a frac sleeve assembly 210. The port 208 can be a plurality of ports in various embodiments.

The frac sleeve assembly 210 includes a sleeve 212 and a ball seat 214 that define a fluid passage 215 through the frac sleeve assembly 210. The frac sleeve assembly 210 can move between a first position and a second position. The first position is relatively closer to the inlet 204 than the second position. When the frac sleeve assembly 210 is in the first position, the sleeve 212 covers a port 208 of the frac assembly 114, thereby closing the port 208. When the frac sleeve assembly 210 is in the second position, the sleeve 212 is away from the port 208, thereby opening the port 208.

Fluid can pass from the inlet 204 to the outlet 206 by passing through the frac sleeve assembly 210. The frac sleeve assembly 210 can be moved from the first position to the second position by dropping a ball 220 into the production string 102 at the surface and allowing the ball 220 to settle onto the ball seat 214, thereby blocking the flow of fluid from the inlet 204 to the outlet 206. The frac fluid 120 entering the frac assembly 114 from the inlet 204 then applies a fluid pressure on the ball 220, forcing the frac sleeve assembly 210 to move towards the outlet 206 as indicated by arrows 225 (i.e., into the second position). In various embodiments, the frac sleeve assembly 210 is originally secured to the housing 202 via shear screws (not shown) and the fluid pressure is applied above a breaking threshold for the shear screws. Once the shear screws are broken, the frac sleeve assembly 210 moves toward the outlet 206 under fluid pressure and uncovers ports 208, allowing the frac fluid 120 to flow out of the housing 202 via the port 208 and into the reservoir 112. The port 208 is closed by moving the frac sleeve assembly 210 toward the inlet 204 (i.e, back to the first position). In various embodiments, the frac sleeve assembly 210 is moved toward the inlet 204 by disintegrating or dissolving the ball 220, thereby relieving the downward pressure of the fluid on the ball seat 214 and frac sleeve assembly 210. A biasing device 230 such as a spring provides a force directed toward inlet 204 in order to return the frac sleeve assembly 210 to its first position in which it covers, and thereby closes, port 208. In an alternate embodiment, the biasing device 230 can be replaced with a lock that allows the frac sleeve assembly 210 to be locked into the open position.

In order to disintegrate the ball 220, a disintegrating fluid is pumped down the production string 102 to the ball 220. The disintegrating fluid can be the frac fluid. The ball 220 is designed to disintegrate when exposed to the disintegrating fluid at a selected temperature. In general, the disintegrating fluid that forces the ball 220 into the ball seat 214 is provided into the production string 102 at a temperature (e.g., about 100° Celsius) below a reaction temperature for the ball 220 and the disintegrating fluid. Over time, the temperature of the disintegrating fluid rises to thermal equilibrium with the downhole temperature. At the downhole temperature, the disintegrating fluid chemically interacts with the ball 220 in order to disintegrate the ball 220. The disintegration process is designed to reduce the size of the ball 220, allowing the ball 220 to pass through the ball seat 214, thereby relieving the pressure from the frac sleeve assembly 210 and allowing the frac sleeve assembly 210 to return to its original position.

During dissolution of the ball 220, the ball 220 can become cemented into position the at ball seat 214, making it difficult for the fluid passage 215 of the ball seat 214 to be opened up, thereby preventing closure of the port 208. Embodiments discussed below provide methods for ensuring removal of the ball 220 from the ball seat 214 and closure of port 208.

Figure 3:
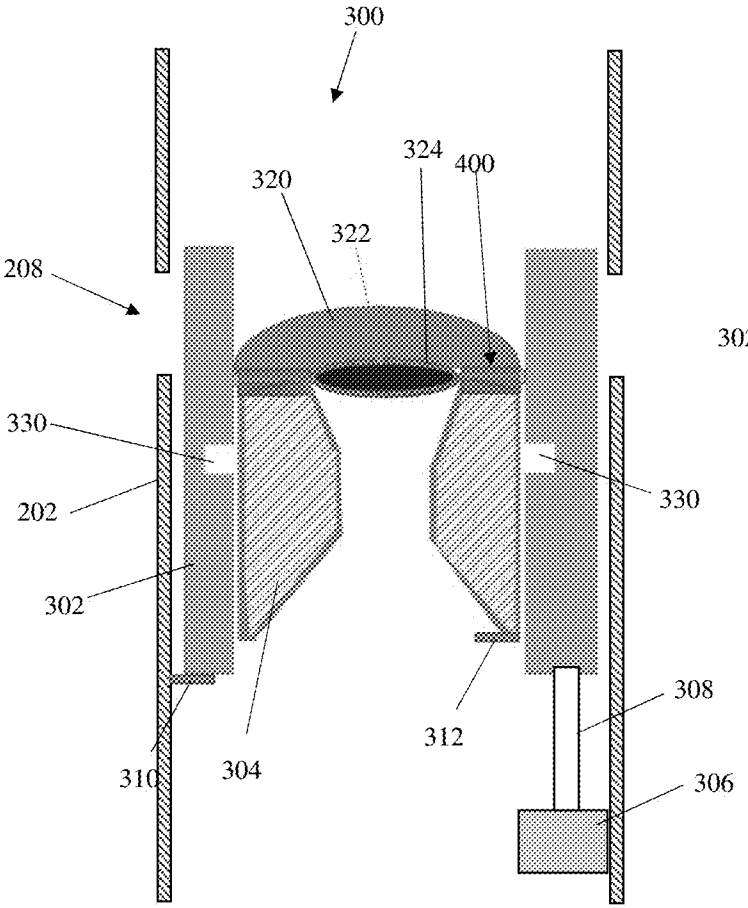
FIG. 3 shows a detailed illustration of a frac sleeve assembly disposed in a housing that allows for opening and closing of a port of the housing.

FIG. 3 shows a detailed illustration of a frac sleeve assembly 300 disposed in a housing 202 that allows for opening and closing of a port 208 of the housing 202. The frac sleeve assembly 300 includes a hollow cylindrical sleeve 302 and a ball seat 304. The sleeve 302 is axially slidable within the housing 202. Additionally, the ball seat 304 is axially slidable within the sleeve 302. A structure 306 on an inner surface of the housing 202 supports a biasing device 308. The biasing device 308 exerts a force on the sleeve 302 in the direction of the inlet, thereby resisting motion of the sleeve 302 toward the outlet of the housing 202. A frac sleeve shear pin 310 maintains the frac sleeve assembly 300 in a first position within the housing 202 until a suitable force is applied to break the frac sleeve shear pin 310. Additionally, a ball seat shear pin 312 secures the ball seat 304 in a selected position within the sleeve 302 until a force having a selected magnitude is applied (e.g., by the ball seat 304) to break the ball seat shear pin 312.

The sleeve 302 further includes one or more pin adjusting elements such as notches 330 at a selected axial location on an inner surface of the sleeve 302. The ball seat 304 includes a funnel section 320 that narrows down to a ridge 324 that defines a hole or passage 322 of a selected radius or diameter. A seat tooth assembly 400, discussed in detail below with respect to FIG. 4, is located at the ridge 324 in order to control the seating and removal of a ball from the ball seat 304.

Figure 4:
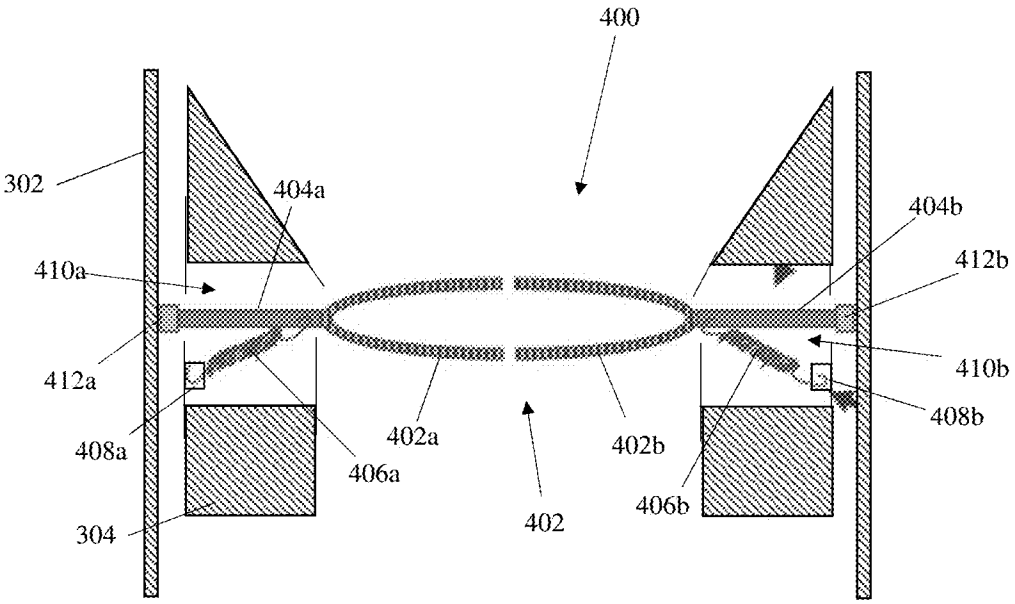
FIG. 4 shows a detailed view of the seat tooth assembly disposed in a ball seat of the frac sleeve assembly.

FIG. 4 shows a detailed view of the seat tooth assembly 400 disposed in the ball seat 304. The seat tooth assembly 400 includes a split ball seat tooth 402 having a first tooth component 402*a* and a separate second tooth component 402*b*. The first and second tooth components (402*a*, 402*b*) each form semi-circles that can be assembled or combined to form the seat tooth 402 having a selected diameter. In various embodiments, the diameter of the seat tooth 402 is the same diameter as the ridge 324 of the ball seat 304. In other embodiments, the diameter of the seat tooth 402 is a smaller than the diameter of the ridge 324. The first tooth component 402*a* covers a first half circumference of the seat tooth 402 while the second tooth component 402*b* covers a second half circumference of the seat tooth 402.

The ball seat 304 includes a radial passage formed therein that passes through the ball seat 304 at the ridge 324. The radial passage forms a first radial passage 410*a* on one side of the ball seat 304 and a second radial passage 410*b* on a radially opposite side of the ball seat 304. The first tooth component 402*a* is coupled to a first retraction pin 404*a* that passes through the first radial passage 410*a*. A first retraction spring 406*a* couples the first retraction pin 404*a* to an inner support structure 408*a* within the first radial passage 410*a*. The first retraction spring 406*a* exerts a radially outward force on the first retraction pin 404*a*. A first outer end 412*a* of the first retraction pin 404*a* is in slidable contact with an inner surface of the sleeve 302 of the frac assembly 300. The sleeve 302 therefore prevents or limits the first retraction pin 404*a* from being forced by the first retraction spring 406*a* radially outward beyond a selected radius. This setup therefore maintains the first tooth component 402*a* at a selected radial position at the ridge 324.

Similarly, the second tooth component 402*b* is coupled to a second retraction pin 404*b* that passes through the second radial passage 410*b*. A second retraction spring 406*b* couples the second retraction pin 404*b* to an inner support structure 408*b* within the second radial passage 410*b*. The second retraction spring 406*b* exerts a radially outward force on the second retraction pin 404*b*. A second outer end 412*b* of the second retraction pin 404*b* is in slidable contact with an inner surface of the sleeve 302 of the frac assembly 300. The sleeve 302 therefore prevents or limits the second retraction pin 404*b* from being forced radially outward beyond a selected radius by the second retraction spring 406*b*. This setup therefore maintains the second tooth component 402*b* at a selected radial position at the ridge 324.

Referring back to FIG. 3, a first stage of operation of the frac sleeve assembly is shown. The biasing device 308 and frac sleeve shear pin 310 maintain the frac sleeve assembly 300 in place over the port 208, thereby keeping the port 208 closed. The ball seat 304 is held in place with respect to the sleeve 302 via ball seat shear pin 312. The first tooth component 402*a* and the second tooth component 402*b* are held in place to form seat tooth 402 at ridge 324.

Figure 5:
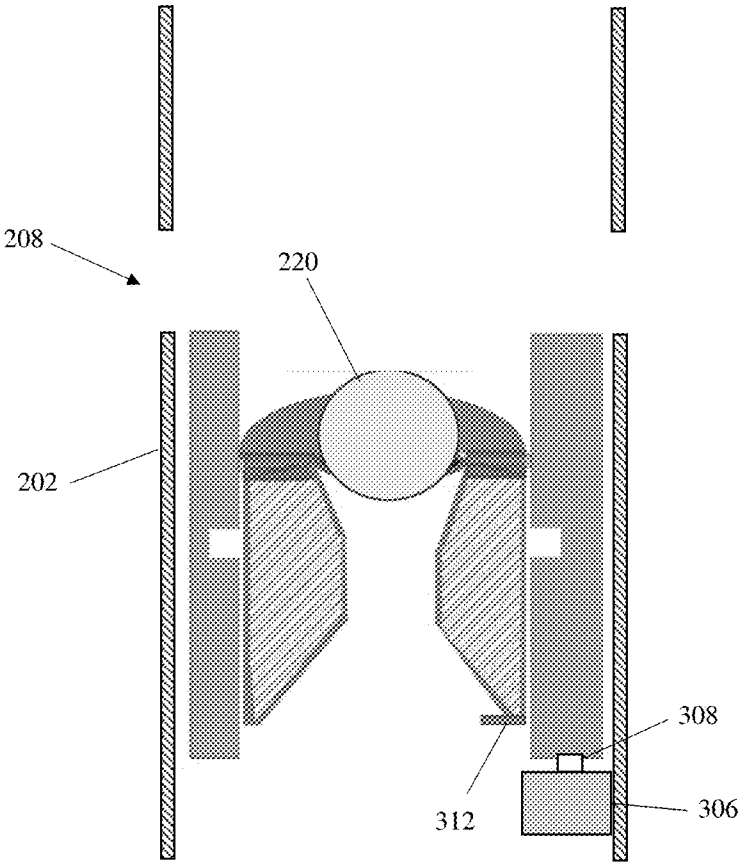
FIG. 5 shows a configuration of the frac seal assembly with ball seated on the ball seat.

Referring now to FIG. 5, a bad 220 has been dropped into the housing 20:2. The ball 220 has a ball diameter that is greater than the diameter of the seat tooth 402 formed by the first tooth component 402*a* and the second tooth component 402*b*. As the ball 220 sits on the seal tooth 402, thereby closing the passage of the ball seat 304, the weight of the ball 220 as well as a build-up of fluid pressure from the surface breaks the frac sleeve shear pin 310 and moves the frac sleeve assembly 300 toward the outlet of the housing 202 in order to expose the port 208. Moving the frac sleeve assembly 300 toward the outlet compresses the biasing device 308. The force that breaks the frac sleeve shear pin 310 is less than a force need to break the ball seat shear pin 312. In an alternate embodiment, the biasing device 308 can be replaced with a lock that allows the frac sleeve assembly 210 to be locked into the open position.

Figure 6:
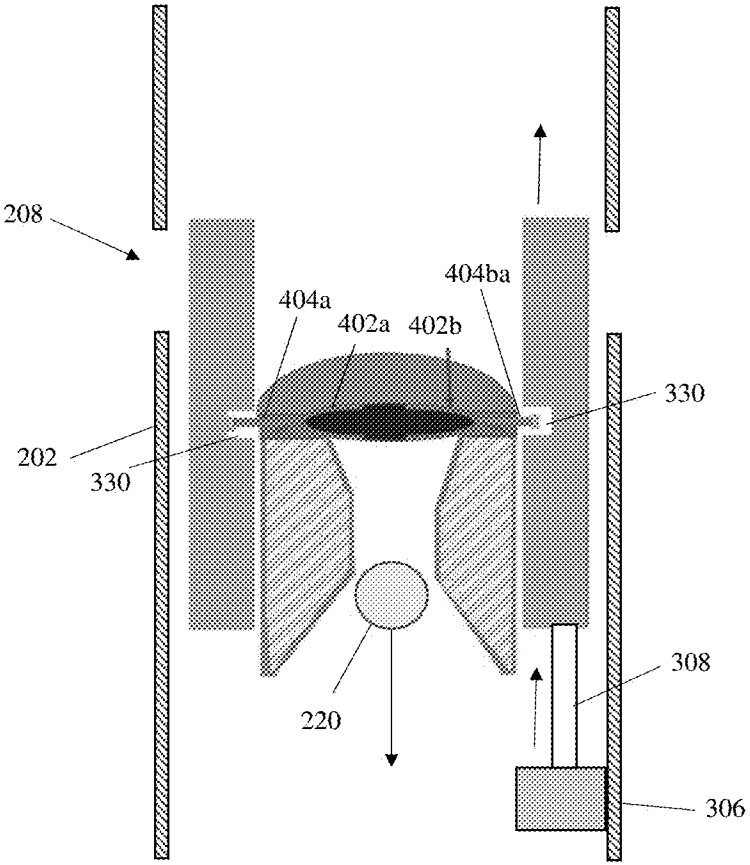
FIG. 6 illustrates an operation for returning the frac sleeve assembly to its first position within the housing to close the port.

Referring now to FIG. 6, an operation is shown for returning the frac sleeve assembly 300 to its first position to close the port 208. Fluid pressure from the surface is increased on the ball 220 in order to provide a force that breaks the ball seat shear pin 312. Once the ball seat shear pin 312 is broken, the applied fluid pressure forces the ball seat 304 to slide axially within the sleeve 302 until the retraction pins (404*a*, 404*b*) are axially aligned with one or more notches 330. Due to the radially outward forces applied by the first retraction spring 406*a* and the second retracting spring 406*b*, the first retraction pin 404*a* and the second retraction pin 404*b* expand radially outward into the one or more notches 330, thereby stopping the axial motion of the ball seat 304 with respect to the sleeve 302. Furthermore, expanding the first retraction pin 404*a* and/or the second retraction pin 404*b* into the one or more notches 330 separates the first tooth component 402*a* from the second tooth component 402*b*, thereby releasing the ball 220 from its location at the ridge 324. Now freed, the ball 220 passes through the ball seat 304 and opens the fluid passage 215 in the ball seat 304. With the fluid passage 215 opened, the fluid pressure exerted on the ball seat 304 is removed or reduced. The biasing device 308 now moves the frac sleeve assembly 300 back to its first position, thereby closing the port 208.

Since the ball 220 is released when the outward movement of the retraction pins 404*a*, 404*b* into their respective notches 330 separates the first tooth component 402*a* from the second tooth component 402*b*, it is not necessary that the ball undergo any disintegration process. However, the ball can undergo some degree of disintegration simultaneously with the process outlined with respect to FIGS. 3-6, in various embodiments.

Figure 7:
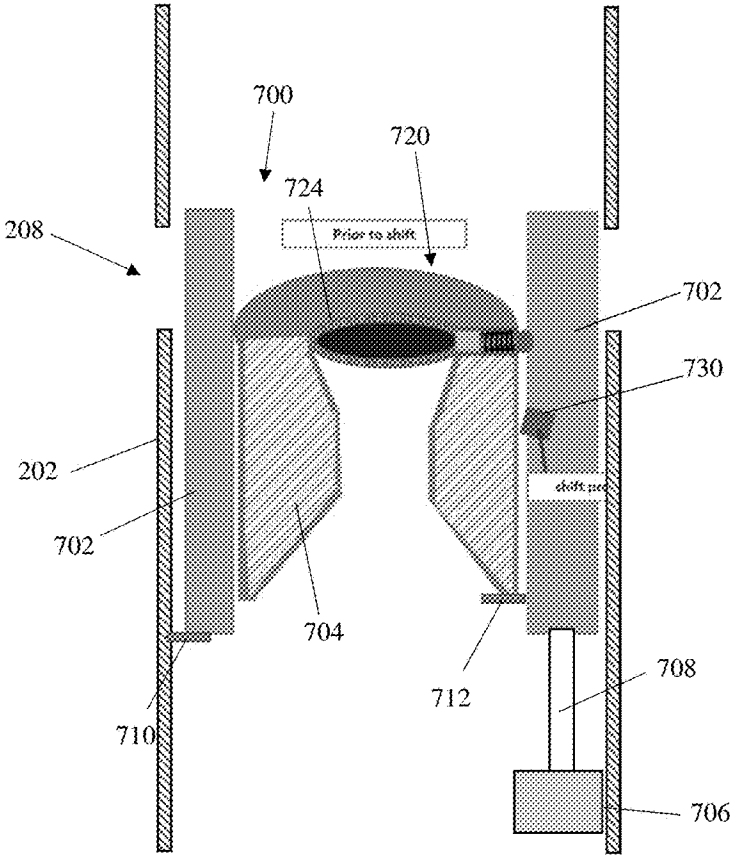
FIG. 7 shows a detailed illustration of a frac sleeve assembly in an alternate embodiment.

FIG. 7 shows a detailed illustration of a frac sleeve assembly 700 in an alternate embodiment. The frac sleeve assembly 700 includes a hollow cylindrical sleeve 702 and a ball seat 704. The sleeve 702 is axially slidable within the housing 202 and the ball seat 704 is axially slidable within the sleeve 702. A structure 706 on an inner surface of the housing 202 supports a biasing device 708. The biasing device 708 exerts a force on the sleeve 702 in the direction of the inlet, thereby resisting motion of the sleeve toward the outlet of the housing 202. A frac sleeve shear screw 710 maintains the face sleeve assembly 700 in a first position within the housing 202 until suitable force is applied to break the frac sleeve shear screw 710. Additionally, a ball seat shear screw 712 secures the ball seat 704 in a selected position within the sleeve 702 until a force having a selected magnitude is applied (e.g., by the ball seat 704) to break the ball seat shear screw 712.

The sleeve 702 further includes a pin adjusting element such as protrusion 730 on an inner surface of the sleeve 702. The ball seat 704 includes a funnel section 720 that narrows down to a ridge 724 that defines a hole or passage of a selected radius or diameter. A seat tooth assembly 800, discussed in detail below with respect to FIG. 8, is located at the ridge 724 in order to control the seating and removal of the ball from the ball seat 704.

Figure 8:
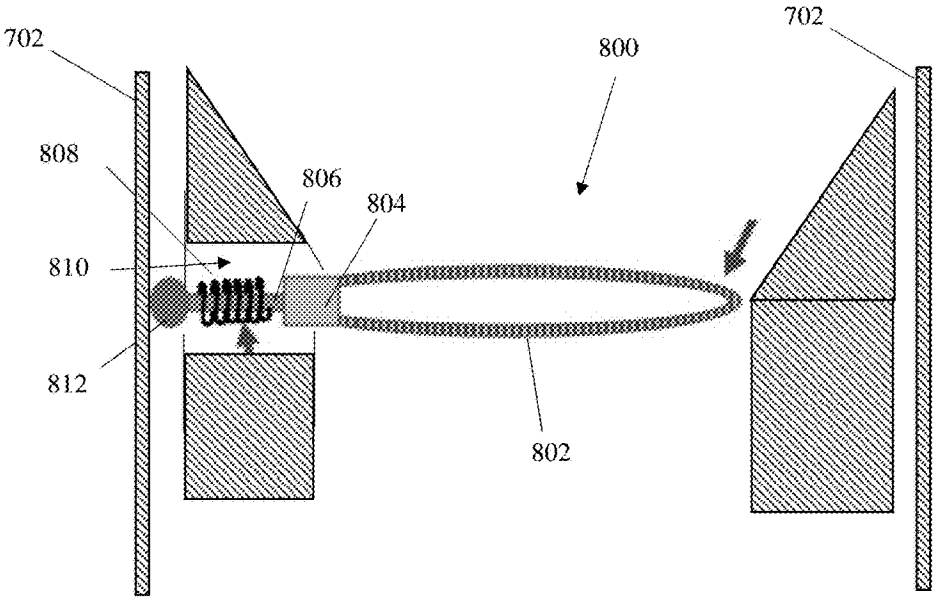
FIG. 8 shows a detailed view of the seat tooth assembly 800 in the alternate embodiment.

FIG. 8 shows a detailed view of the seat tooth assembly 800 in the alternate embodiment. The seat tooth assembly 800 includes a continuous seat tooth 802. A first end of the seat tooth 802 is secured to a mount 804 and the slack of the seat tooth 802 forms and loop and passes through a hole in the mount 804. A second end of the seat tooth 802 is coupled to a retraction pin 806 having an associated biasing spring 808. The biasing spring 808 exerts a force on the retraction pin 806 to direct the retraction pin 806 away from mount 804. The retraction pin 806 is disposed within a radial passage 810 formed in the ball seat 704. The mount 804 can be secured with the radial passage 810 to allow motion of the retraction pin 806 with respect to the mount 804. The retraction pin 806 includes an end portion 812 that settle against an inner wall of sleeve 702. In this position, the diameter of the seat tooth 802 forms a loop having a selected diameter.

Referring back to FIG. 7, a first stage of operation of the frac sleeve assembly is shown. The biasing device 708 and frac sleeve shear screw 710 maintain the frac sleeve assembly 700 in place over the port 208, thereby keeping the port 208 closed. The ball seat 704 is held in place with respect to the sleeve 702 via ball seat shear screw 712.

Figure 9:
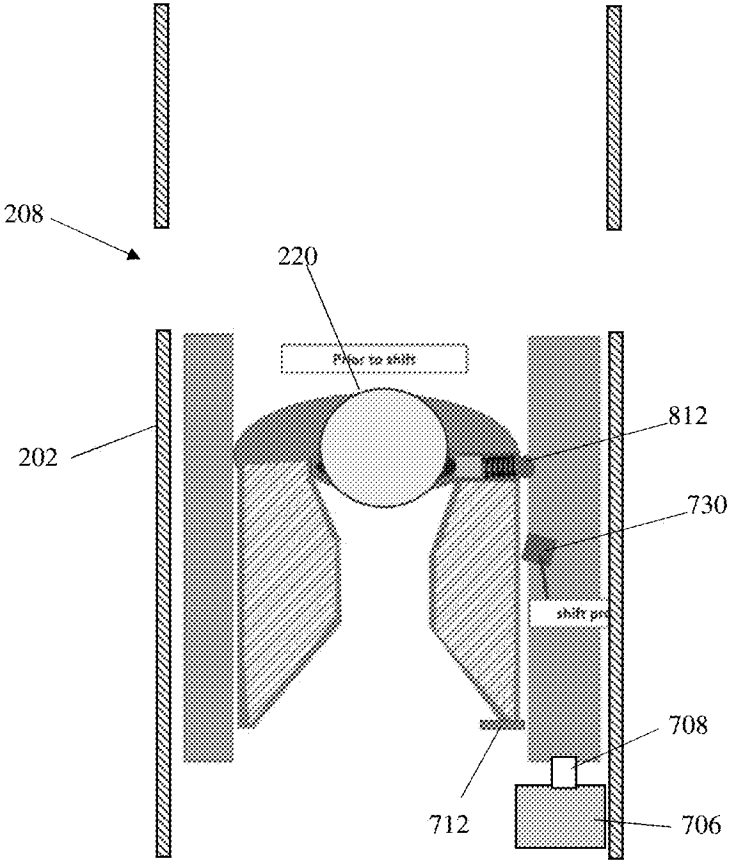
FIG. 9 shows a configuration of the frac sleeve assembly of FIG. 7 with a ball seated on a ball seat of the frac sleeve assembly.

Referring now to FIG. 9, a ball 220 is dropped into the housing 202. The ball 220 has a ball diameter that is greater than the diameter of the loop formed by seat tooth 802 and therefore seats onto the seat tooth 802, thereby closing the fluid passage through the ball seat 704. The build-up of fluid pressure from the surface breaks the frac sleeve shear screw 710 and moves the frac sleeve assembly 700 toward the outlet of the housing 20:2, thereby exposing the port 208 and compressing the biasing device 708.

Figure 10:
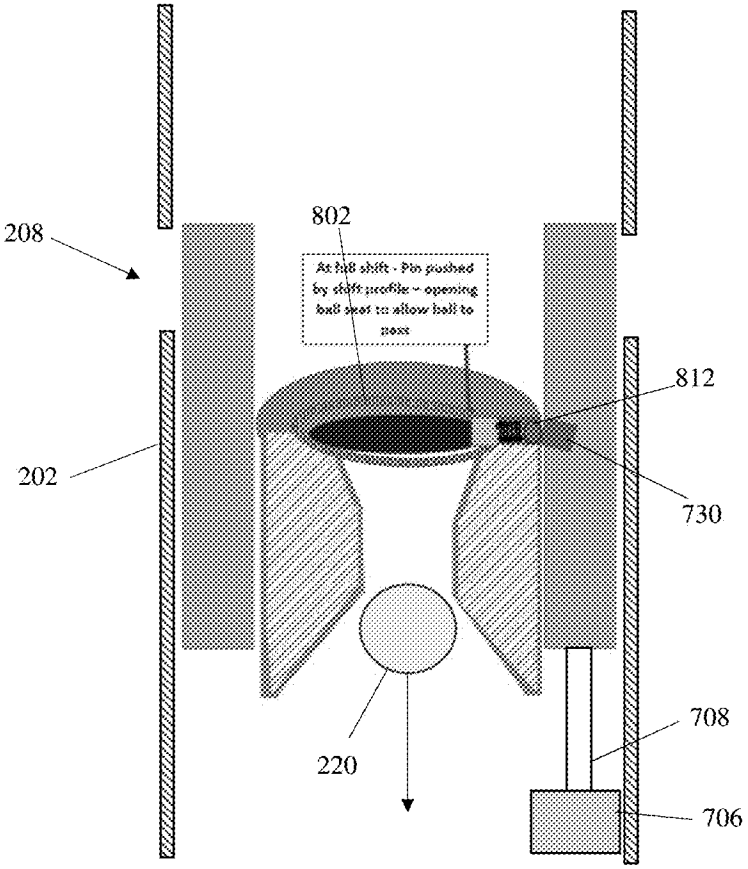
FIG. 10 illustrates an operation for returning the frac sleeve assembly to its first position within the housing to close the port.

Referring now to FIG. 10, an operation is shown for returning the frac sleeve assembly 700 to its first position to close the port 208. Increased fluid pressure from the surface on the ball 220 provides a force that breaks the ball seat shear pin 71:2. The applied pressure then forces the ball seat 704 to slide axially within the sleeve 702 to an axial location at which the end 812 of retraction pin 806 reaches the protrusion 730. The protrusion 730 forces the retraction pin 806 radially inward, thereby increase the amount of slack in the seat tooth and thus the circumference of the seat tooth 802. With the circumference of the seat tooth 802 enlarged, the ball 220 passes through the seat tooth 802 and ball seat 704 to open the fluid passage 215 in the ball seat 704. With the fluid pressure on the ball seat 704 removed or reduced, the biasing device 708 now moves the frac sleeve assembly 700 back to the first position, thereby closing the port 208.

Set forth below are some embodiments of the foregoing disclosure:

Embodiment 1

A frac sleeve assembly for use in a downhole operation, comprising: a sleeve movable within a housing, the sleeve including a pin adjusting element; and a ball seat movable within the sleeve, the ball seat comprising a seat tooth disposed at a fluid passage of the ball seat for seating a ball, and a pin associated with the seat tooth, wherein motion of the ball seat within the sleeve causes the pin adjusting element to move the pin to adjust the seat tooth to release the ball.

Embodiment 2

The frac sleeve assembly of any previous embodiment, wherein the seat tooth is disposed at a ridge of a funnel section of the ball seat in order to receive the ball.

Embodiment 3

The frac sleeve assembly of any previous embodiment, further comprising a spring for moving the element in a selected direction.

Embodiment 4

The frac sleeve assembly of any previous embodiment, wherein the seat tooth includes two tooth components and the pin moves in a radially outward direction to separate the two tooth components to release the ball.

Embodiment 5

The frac sleeve assembly of any previous embodiment, wherein the pin adjusting element is a recess in the sleeve and the ball seat moves along a longitudinal axis of a sleeve to engage the pin with the recess to allow the pin to move radially outward.

Embodiment 6

The frac sleeve assembly of any previous embodiment, wherein the pin moves radially inward to expand a circumference of the seat tooth.

Embodiment 7

The frac sleeve assembly of any previous embodiment, wherein the pin adjusting element is a protrusion in the sleeve and the ball seat moves along a longitudinal axis of a sleeve to engage the pin with the protrusion to move the pin radially inward to expand the opening of the seat tooth.

Embodiment 8

The frac sleeve assembly of any previous embodiment, further comprising a shear pin that retains the ball seat at a selected location.

Embodiment 9

A method of operating a frac system, comprising: receiving a ball at a seat tooth disposed at a fluid passage of a ball seat, the seat tooth having an associated pin; and moving the ball seat within a sleeve to a location at which a pin adjusting element of the sleeve moves the pin to adjust the seat tooth to release the ball.

Embodiment 10

The method of any previous embodiment, further comprising a spring for moving the element in a selected direction.

Embodiment 11

The method of any previous embodiment, wherein the seat tooth includes two tooth components, further comprising moving the pin in a radially outward direction to separate the two tooth components to release the ball.

Embodiment 12

The method of any previous embodiment, wherein the pin adjusting element is a recess in the sleeve, further comprising moving the ball seat moves along a longitudinal axis of a sleeve to engage the pin with the recess to move the pin radially outward to separate the two tooth components to release the ball.

Embodiment 13

The method of any previous embodiment, further comprising moving the pin radially inward to expand a circumference of the seat tooth.

Embodiment 14

The method of any previous embodiment, wherein the pin adjusting element is a protrusion in the sleeve, further comprising moving the ball seat along a longitudinal axis of a sleeve to engage the pin with the protrusion to move the pin radially inward to expand the opening of the seat tooth.

Embodiment 15

The method of any previous embodiment, further comprising breaking a shear pin that retains the ball seat at a selected location in order to move the ball seat with respect to the sleeve.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A frac sleeve assembly for use in a downhole operation, comprising:

a sleeve movable within a housing, the sleeve including a pin adjusting element; and a ball seat movable within the sleeve, the ball seat comprising:

a radial through passage formed therein;

a seat tooth disposed at a fluid passage of the ball seat for seating a ball, and a pin associated with the seat tooth and disposed within the radial through passage, the pin having an end in contact with an inner surface of the sleeve, wherein motion of the ball seat within the sleeve causes the pin adjusting element to move the pin through the radial through passage to adjust the seat tooth to release the ball.

2. The frac sleeve assembly of claim 1, wherein the seat tooth is disposed at a ridge of a funnel section of the ball seat in order to receive the ball.

3. The frac sleeve assembly of claim 1, further comprising a spring for exerting a radial force on the pin in the radial through passage.

4. The frac sleeve assembly of claim 1, wherein the seat tooth includes two tooth components and the pin moves in a radially outward direction to separate the two tooth components to release the ball.

5. The frac sleeve assembly of claim 3, wherein the pin adjusting element is a recess in the sleeve and the ball seat moves along a longitudinal axis of a sleeve to engage the pin with the recess to allow the pin to move radially outward.

6. The frac sleeve assembly of claim 1, wherein the pin moves radially inward to expand a circumference of the seat tooth.

7. The frac sleeve assembly of claim 6, wherein the pin adjusting element is a protrusion in the sleeve and the ball seat moves along a longitudinal axis of a sleeve to engage the pin with the protrusion to move the pin radially inward to expand the opening of the seat tooth.

8. The frac sleeve assembly of claim 1, further comprising a shear pin that retains the ball seat at a selected location.

9. A method of operating a frac system, comprising:

receiving a ball at a seat tooth disposed at a fluid passage of a ball seat, the ball seat having a radial through passage formed therein, the seat tooth having an associated pin disposed within the radial through passage, the pin having an end in contact with an inner surface of a sleeve; and moving the ball seat within the sleeve to a location at which a pin adjusting element of the sleeve moves the pin through the radial through passage to adjust the seat tooth to release the ball.

10. The method of claim 9, further comprising exerting a radial force on the pin via a spring.

11. The method of claim 9, wherein the seat tooth includes two tooth components, further comprising moving the pin in a radially outward direction to separate the two tooth components to release the ball.

12. The method of claim 11, wherein the pin adjusting element is a recess in the sleeve, further comprising moving the ball seat moves along a longitudinal axis of a sleeve to engage the pin with the recess to move the pin radially outward to separate the two tooth components to release the ball.

13. The method of claim 9, further comprising moving the pin radially inward to expand a circumference of the seat tooth.

14. The method of claim 13, wherein the pin adjusting element is a protrusion in the sleeve, further comprising moving the ball seat along a longitudinal axis of a sleeve to engage the pin with the protrusion to move the pin radially inward to expand the opening of the seat tooth.

15. The method of claim 9, further comprising breaking a shear pin that retains the ball seat at a selected location in order to move the ball seat with respect to the sleeve.

* * * * *